United States Patent [19]

Epsztein

[11] Patent Number: 5,070,282

[45] Date of Patent: Dec. 3, 1991

[54] AN ELECTRON SOURCE OF THE FIELD EMISSION TYPE

[75] Inventor: Bernard Epsztein, Sceaux, France

[73] Assignee: Thomson Tubes Electroniques, Boulogne Billancourt, France

[21] Appl. No.: 451,790

[22] Filed: Dec. 18, 1989

[30] Foreign Application Priority Data

Dec. 30, 1988 [FR] France ..... 88 17484

[51] Int. Cl.[5] ..... H01J 29/52

[52] U.S. Cl. ..... 315/383; 313/336

[58] Field of Search ..... 315/383; 313/336, 309, 313/306

[56] References Cited

U.S. PATENT DOCUMENTS 3,753,022 8/1973 Fraser, Jr. .
3,810,025 5/1974 Aihara et al. ..... 313/336
4,513,308 4/1985 Green et al. .
4,578,614 3/1986 Gray et al. ..... 313/336
4,596,942 6/1986 Oshima et al. ..... 313/336
4,663,559 5/1987 Christensen .
4,721,885 1/1988 Brodie ..... 313/336

*Primary Examiner*—Theodore M. Blum
*Attorney, Agent, or Firm*—Oblon, Spivak, McClelland, Maier & Neustadt

[57] ABSTRACT

An electron source is formed by at least one elementary electron emitter in which an emissive point having a very small radius of curvature operates on the field emission principle and produces an electron beam, the intensity of which is independent of any possible variations of electron emission. The emissive point cooperates with an extracting electrode, and a control electrode having a negative potential with respect to the extracting electrode is placed downstream of the extracting electrode with respect to the direction of propagation of the beam.

9 Claims, 1 Drawing Sheet

AN ELECTRON SOURCE OF THE FIELD EMISSION TYPE

BACKGROUND OF THE INVENTION

1. Field of the Invention

The present invention relates to an electron source which operates on the principle of field emission. The aim of the invention is to improve sources of this type, particularly when they are constructed by means of methods relating to the technology of integrated circuits or to the field of deposition of thin films on a substrate as is the case, for example, with the fabrication of MOS transistors.

2. Description of the Prior Art

Over the past few years, the techniques already employed for integrated circuits or in the field of thin films have led to substantial progress in the fabrication of field-emission electron sources. These techniques make it possible in particular to obtain structures having very small dimensions which utilize in each case a point having a very small radius of curvature. The point is made emissive under the influence of an electric field produced by means of an electrode which is brought to a positive potential with respect to the potential of the point. This structure having a point constitutes an elementary electron-emitting device which can form a microtube of the triode type, for example, or else an electron microgun, and this elementary device may be employed alone or combined with other similar devices.

The operation and the methods of construction of a field-emission electron source formed by a plurality of elementary emitter devices are known in particular from studies carried out at Stanford Research Institute by C. A. Spindt and published in various reviews including Applications of Surface Science, 2, pages 149-163 (1979) and Applications of Surface Science 16 (1983) pages 268-276, as well as the Journal of Applied Physics, vol. 47, No. 12, December 1976, pages 5248-5263.

Another document which may also be cited is French patent Application No. 2,568,394 which mentions the researches of C. A. Spindt and describes different modes of operation and construction of cathodes each formed by a plurality of micropoints which emit electrons in accordance with the principle of field emission. Each micropoint is capable of emitting an electron beam which bombards a cathodoluminescent anode forming the screen of a visual display device. Examples of utilization and fabrication of micropoints in order to constitute field-emission cathodes are also found in a French patent Application No. 80 26934 published under No. 2,472,264, and in U.S. Pat. No. 4,513,308.

FIG. 1 of the accompanying drawings illustrates schematically by way of example an elementary field-emission electron emitter device of known type. The emitter device 1 is formed on a substrate 2 which is shown partly but the dimensions of which can permit the construction of a plurality of emitter devices 1 placed side by side in a matrix arrangement, for example. The substrate 2 is of semiconductor material such as silicon, for example, but could also be a conductive layer such as aluminum, for example. In the example shown, the substrate 2 is cut so as to have a well 3 at the center of which remains a protuberance 4 of conical shape. The well 3 is centered about an axis 5 which is intended to constitute the axis of an electron beam 6. Thus, in the example illustrated, the protuberance or cone 4 is of the same material as the substrate 2, its base is integral with the bottom wall of the well 3, its summit or point 7 is oriented towards the exterior of the well 3 and located on the longitudinal axis 5. It is worthy to note that the cone 2 could be metallic as explained in the documents cited earlier and that it could also be added on the substrate 2.

An electrically insulating layer 9 is present on the surface 10 of the substrate 2. The insulating layer 9 carries a layer 11 of electrically conductive material and has an opening opposite to the well 3 so as to surround this latter. The layer 11 thus constitutes about the longitudinal axis 5 an annular electrode which is intended for example to constitute an electrode having a function corresponding to the function performed by a Wehnelt electrode as employed in particular in electron guns of cathode-ray tubes. Above the Wehnelt electrode 11 is deposited an electrically insulating layer 12 which is open opposite to the well 3 and separates the Wehnelt electrode 11 from a second electrically conductive layer 13. This second electrically conductive layer 13 is also open opposite to the well 3 so as to form a second annular electrode 13 which is centered about the longitudinal axis 5.

The second electrode 13 is brought to a positive potential of 100 volts, for example, with respect to a reference potential applied to the substrate 2, the Wehnelt electrode 11 being, for example, at a potential in the vicinity of or equal to that of the substrate 2.

Under these conditions, the point 7 emits electrons under the influence of the electric field produced by the potential of the second electrode 13 which thus constitutes an extracting electrode. The electrons emitted by the point 7 form an electron beam 6 which could if necessary be accelerated to a greater extent by means of additional electrodes. However, the electrode 13 could also be replaced by an anode without opening for the passage of the beam, as described in the French patent Application No. 2,568,394 which has already been cited.

The dimensions of the structure of the emitter device 1 are of the order of a few micrometers. By way of example, the diameter D of the well 3 can be two or three micrometers, the height H of the cone 4 can be of the order of one micrometer, and the radius of curvature (not shown) of the point 7 which constitutes the emissive point can be of the order of 0.06 micrometer. With this type of emitter device, it is possible to obtain an electron current, the mean intensity of which can be of the order of 25 microamperes and which can attain and even exceed (at a peak value) 100 microamperes.

A large number of these emitter devices can be associated in parallel and especially in the form of a matrix, thus obtaining the equivalent of an electron source or macroscopic cathode, the current of which can be modulated by the voltage of the extracting electrodes 13.

It is also possible to employ each elementary emitter device as a microtube electron gun, and to associate and combine a large number of such devices in order to form the equivalent of an integrated circuit, the semiconductor components being thus replace by vacuum microtubes.

Sources of this type offer many advantages. Compared with the cathodes and electron guns in conventional use, and especially in microwave tubes, they provide in particular the following advantages:

absence of heating and instantaneous operation;

the possibility of modulating the current with a low modulation voltage and at low impedance, hence the possibility of operation with a very broad band;

global current density considerably higher than the value which can be obtained in the present state of knowledge by making use of conventional means (at the present time, the maximum value is of the order of 10 amperes/cm$^2$).

With respect to semiconductor components, the advantages are as follows:

the possibility of distinctly higher power per element;

absence of losses within the material;

distinctly higher microwave frequency efficiency;

insensitivity to ionizing radiation;

much greater immunity to electromagnetic pulses;

possibilities of applications to visual display.

In spite of these numerous advantages, this technique is little used by reason of the fact that it is subject in particular to the following disadvantages:

considerable variation of emission from one emissive point to another as a function of the radius of curvature which cannot be controlled in practice;

non-linearity of the modulation characteristic;

substantial random variation in time of the current emitted by a point, this being due to the temporary presence on the point of residual gas molecules which modify the work function. It may even happen that the work function is reduced to such a point that the intensity of the current emitted by the point is sufficient to melt this latter by Joule effect. Furthermore, random current variation results in considerable noise;

the electrons emitted by the point constitute a highly divergent beam which is practically non-refocusable.

SUMMARY OF THE INVENTION

The present invention relates to an electron source formed by at least one elementary field-emission device of a type similar to those described in the foregoing and capable of constituting a vacuum microtube or a microgun which can be applied to a visual display of an elementary image point or else, for example, a microgun associated with a large number of similar devices mounted in parallel with a view to forming a macroscopic cathode.

The aim of the invention is to improve the elementary electron-emitting device so as to overcome the disadvantages mentioned in the foregoing while at the same time retaining a high electron emission capacity and while retaining the possibility of constructing these elementary emitter devices by means of the techniques employed in the field of integrated circuits or in the field of thin films.

In accordance with the invention, an electron source producing electrons which are intended to constitute at least one electron beam, comprising at least one elementary electron-emitting device of the field emission type, the emitter device being provided with an electron-emissive point brought to a reference potential, an extracting electrode brought to a positive potential with respect to the reference potential, the extracting electrode being provided with a hole for the passage of electrons emitted by the emissive point, is distinguished by the fact that the emitter device is provided in addition with at least one control electrode having a hole for the passage of electrons, the control electrode being placed downstream of the extracting electrode with respect to the direction of propagation of the beam, the control electrode being at a negative potential with respect to the extracting electrode, and that means for accelerating the beam are placed downstream of the control electrode.

Owing to the presence of the control electrode and its arrangement, and the fact that it is located downstream of the extracting electrode, the control electrode has no action on the emission of electrons by the emissive point but does, on the other hand's slow down the electrons which have passed beyond the level of the extracting electrode. In addition, the control electrode tends to act as an electrostatic lens by causing the electrons to converge towards the axis of the beam and also tends to reflect towards the extracting electrode the electrons which have high transverse velocities. These actions of the control electrode are more or less marked, especially as a function of the value of the potential which is applied thereto. This results in an accumulation of electrons upstream of the control electrode and in the creation of a virtual cathode located substantially at the level of the control electrode and on the axis of the beam. In consequence, the electron beam downstream of the control electrode, namely the useful beam emitted by the virtual cathode, has a small divergence and its intensity depends practically only on the geometry of the virtual cathode, this geometry being controlled by the value of the potential applied to the control grid.

DETAILED DESCRIPTION OF THE INVENTION

Figure 2:
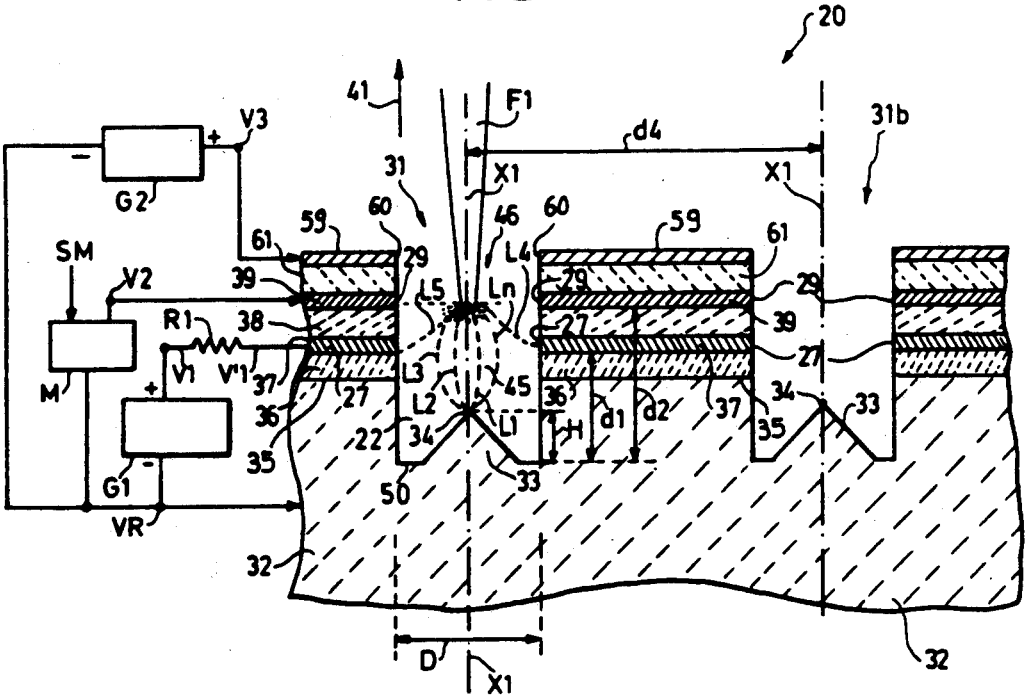
FIG. 2 is a schematic sectional view which shows the characteristic elements of an improved elementary field-emission device in accordance with the invention.

FIG. 2 is a schematic sectional view of an electron source 20 which can comprise one or a plurality of elementary electron-emitting devices in accordance with the invention. However, in the non-limitative example described, only two emitter devices 31, **31*b* are shown for the sake of enhanced clarity of FIG. 2. In the non-limitative example of the description, the emitter devices 31, 31*b* are formed from a substrate 32 of semiconductor material such as silicon, for example. Since these two emitter devices are identical, only the first device 31** will therefore be described in order to simplify the description.

The substrate 32 is cut so as to form a hole or well 22 centered on a longitudinal axis X1 which is intended to constitute the axis of an elementary electron beam F1. The well 22 is cut so as to retain, at the center and at the bottom of this latter, a protuberance 33 of conical shape whose summit or point 34 is oriented towards the exterior of the well and is located on the longitudinal axis X1. On the surface 35 of the substrate 32 is deposited a layer 36 of electrically insulating material. The insulating layer 36 in turn carries a layer 37 of electrically conductive material. These layers 36, 37 are open opposite to the well 22 with the same diameter D as this latter. In consequence, the electrically conductive layer 37 forms an annular electrode 27 which is centered about the longitudinal axis X1 or axis of the elementary beam and which is intended to constitute an extracting electrode 27. Above the extracting electrode 27, provision is made for another insulating layer 38 which separates the extracting electrode 27 from a second conductive layer 39. The two layers 38, 39 are open opposite to the well 22 so as to provide a passageway for the electrons emitted by the emissive point 34 and in order to ensure that the electrically conductive layer 39 constitutes an annular control electrode 29 centered about the longitudinal axis X1. The electrons emitted by the emissive point 34 are intended to form the elementary beam F1, the direction of propagation of the beam F1 being indicated in the figure by an arrow 41.

Figure 1:
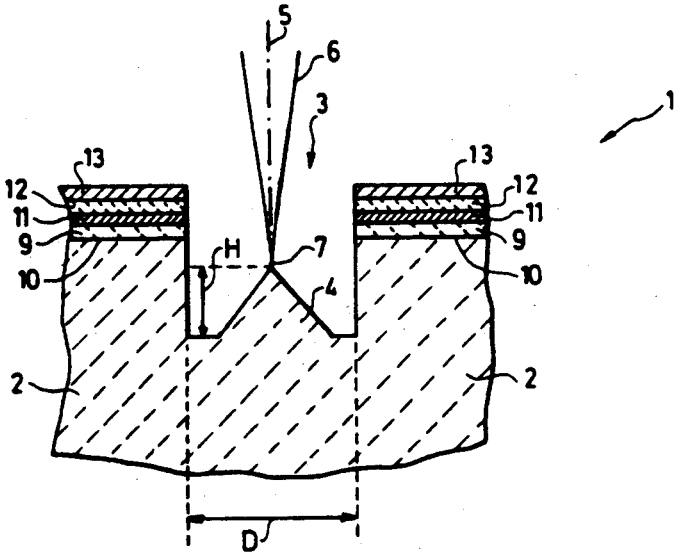
FIG. 1 described earlier shows an elementary field-emission electron emitter device in accordance with the prior art.

The principle of operation of the elementary emitter device 31 is similar to the operation of the emitter device in accordance with the prior art as shown in FIG. 1 but only in regard to the "electron extraction" portion. In fact, the emissive point 34 emits electrons under the influence of the electric field produced by an extraction potential V1 which is applied to the extracting electrode 27. This potential V1 is positive with respect to a reference potential VR of the substrate 32, that is, of the emissive point 34.

As has been mentioned earlier, in contrast to the emitter device of the prior art as shown in the diagram of FIG. 1, the elementary emitter device 31 of the invention as shown in FIG. 2 does not have any Wehnelt electrodes since they are not essential to the operation of the device, either in the case of the device of the prior art or in the case of the device in accordance with the invention. This is due to the fact that, particularly in the prior art, modulation of the electron beam can be performed by modulating the potential applied to the extracting electrode. In the elementary emitter device 31 of the invention, modulation of the elementary beam F1 is obtained in a novel and particularly advantageous manner by means of the control electrode 29 placed downstream of the extracting electrode 27 with respect to the direction of propagation 41 of the elementary beam. It is readily apparent that a Wehnelt electrode of the type shown in FIG. 1 could also be mounted in the emitter device 31 of the invention in which it would be placed upstream of the extracting electrode 27 and brought to a potential in the vicinity of the reference potential VR.

Taking into account the shape and relative positions of the emissive point 34 and of the extracting electrode 27, the potential distribution or potential diagram between these elements produces a considerable divergence of a primary beam 45 formed between the emissive point 34 and the extracting electrode 27 by the electrons emitted by the emissive point 34. It is noted that high transverse velocities are present in respect of a high proportion of electrons emitted by the point. This substantial divergence from the emissive point 34 is indicated in FIG. 2 by a number n of electron paths L1, L2, . . . , Ln, the number n of the paths shown being small for the sake of greater clarity of the figure. It is observed that, starting from the emissive point 34, some of these paths such as the paths L1, L2, for example, diverge only slightly from the longitudinal axis X1 which constitutes the emission axis whereas the other paths L3, Ln diverge considerably until they reach substantially the level of the extracting electrode 27 along the longitudinal axis X1.

In accordance with a distinctive feature of the invention, the extracting electrode 27 is followed in the direction 41 of propagation of the beam by the control electrode 29 which is brought to a negative control potential V2 with respect to the potential V1 of the extracting grid 27. In the case of the electrons (represented by the paths L1 to Ln) emitted by the emissive point 34, the influence of the control grid 29 is exerted particularly from the instant at which the electrons reach the level of the extracting electrode 27. Since the control electrode 29 is negative with respect to the extracting electrode 27, it slows-down these electrons which constitute the primary beam 45. The presence of the primary beam 45 has the effect of cutting the potential diagram and, as a function of the control potential V2 applied to the control electrode 29, the beam is partially reflected as represented in FIG. 2 by paths L4, L5 which meet the extracting electrode 27 and which show that this electrode is capable of collecting the electrons thus reflected.

There is accordingly created, substantially at the level of the control electrode 29 and on the longitudinal axis X1, a virtual cathode 46 (represented schematically by a cloud of dots) which can be traversed for the purpose of forming the elementary electron beam F1 only by electrons which depart only slightly from the longitudinal axis X1 when there is divergence or convergence, or in other words there is created a virtual cathode 46 which can be traversed only by electrons having sufficient longitudinal energy, that is to say by electrons having low transverse velocity.

It may be considered that the virtual cathode 46 constitutes a reserve supply of electrons or a plasma of electrons, with the result that the intensity of the elementary electron beam F1 or useful beam is practically independent of the primary source represented by the emissive point 34, and independent of the variations in electron output of said primary source 34. The intensity of the elementary beam or useful beam F1 depends only on the geometry of the virtual cathode 46 which is controlled by the potential V2 applied to the control electrode 29. A positive variation of the potential V2 applied to the control electrode 29 entails the need to increase the intensity of the elementary electron beam F1 or useful beam and even to cause the disappearance of the virtual cathode 46. In order to achieve the most satisfactory operation, it is therefore necessary to ensure that the mean intensity of the primary beam 45 emitted by the emissive point 34 has a value substantially equal to or higher than the mean intensity of the useful beam F1 emitted by the virtual cathode 46.

This is obtained by adjusting the values of certain parameters such as in particular the value of the potentials V1, V2 as a function of the value of the desired intensity of the useful beam 40 and as a function of the dimension of the structure and of the distances between the electrodes. By way of nonlimitative example, there are indicated below a few values which can be conferred on these parameters:

the diameter D of the well 22 is of the order of 2 micrometers; the height H of the cone 33 is of the order of 1 micrometer; the radius of curvature (not shown) of the summit or emissive point 34 is of the order of 0.06 micrometer; the distance d1 between the bottom 50 of the well 32 and the extracting electrode 27 is of the order of 2 micrometers; the distance d2 between the bottom wall 50 and the control electrode 29 is of the order of 3 to 4 micrometers; the electrically conductive layers from which the electrodes 27, 29 are formed have a thickness (not indicated) of the order of 1 micrometer. Furthermore, under these conditions, the substrate 32 being of silicon, the reference voltage VR being at 0 volt, for example, the potential V1 applied to the extracting electrode 27 has a value of approximately +100 volts and the control potential V2 applied to the control grid 29 has substantially the same mean value as the reference potential VR, in respect of an intensity of the elementary primary electron beam F1 or useful beam, in continuous operation, of the order of 50 microamperes.

The control potential V2 applied to the control electrode 29 can be variable, especially with a view to modulating the useful beam F1. In fact, within the scope of the conditions mentioned above, a negative potential of a few volts applied to the electrode 29 is sufficient to block the useful beam F1. A variation of about ten volts, for example, on the control electrode 29 is sufficient to obtain all the values of intensity IF of the useful beam F1: the characteristic $IF=f(V2)$ is related to the characteristic $I_p=f(V_g)$ of a tube of the tetrode type and has the same linearity.

It should be noted that, beyond the control grid 29, the electrons which constitute the elementary beam or useful beam F1 can be reaccelerated by means of an auxiliary anode or an accelerating electrode, or a cathodoluminescent anode, or by any other accelerating means of conventional design and already contained in the device (not shown) in which the source 20 can constitute a cathode, in a microwave tube (not shown), for example. In such a case, the elementary emitter device 31 can be of the triode type. In other words, its structure can be limited to the emissive point 34, the extracting electrode 27 and the control electrode 29, the high-voltage portion of the microwave tube being used to accelerate the beam.

However, it is also possible, as shown in FIG. 2, to reaccelerate the electrons by means of an auxiliary anode 60 placed downstream of the control electrode 29. The auxiliary anode 60 can be constructed from an electrically conductive layer 59 which is separated from the control electrode 29 by an insulating layer 61, these two layers 59, 61 being etched so as to be open opposite to the well 22 and so as to allow the useful beam F1 to pass through.

In the non-limitative example of the description, the cone 33 which serves to form the emissive point 34 is formed from the substrate 32 which is of silicon in the example considered. Within the spirit of the invention, however, the substrate 32 could be of another type. In addition, the cone 33 could be constructed of material which is different from that which forms the substrate 32 and may consist of electrically conductive material such as, for example, tungsten or molybdenum (in accordance with the teachings of the documents cited earlier) which would be added on the bottom wall 50 of the well 22 and etched so as to constitute the emissive point 34.

Finally, it is worthy to note that, in order to prevent Joule-effect melting of the emissive point 34 when this latter emits an electron current having an intensity which is too high, it is possible to reduce the value of the potential V1 applied to the extracting electrode 27, this being the case as long as the intensity of the emitted current is too high. To this end, it is possible for example to mount a resistor R1 in series with the supply of the extracting electrode 27, that is to say between this latter and the extraction potential V1. In consequence, if emission by the emissive point 34 becomes too strong, a high proportion of the electrons of the primary beam 45 is reflected by the virtual cathode 46. These electrons fall back onto the extracting electrode 36 and are collected by this latter. If the value of the resistor R1 is correctly chosen, the new extraction potential V'1 applied to the extracting electrode 27 by virtue of the presence of the resistor R1 decreases to a sufficient extent to restore the intensity of the emission to a suitable value.

This configuration is illustrated schematically in FIG. 2 which shows that the resistor R1 is connected at one end to the conductive layer 37 which serves to constitute the extracting electrode 27 and at the other end to the positive (+) pole of a voltage generator G1 which delivers the extraction voltage V1. The other pole of the generator is connected to the substrate 32 and forms the reference voltage VR. Furthermore, in the non-limitative example described, the control electrode 29 is connected to the reference voltage VR by means of a modulating device M to which can be applied a modulating signal SM and which makes it possible to adjust the second control potential V2 applied to the control electrode 29. The modulating signal SM may if necessary be superimposed on the control potential V2. A second voltage generator G2 delivers through a positive (+) output the third potential V3 of +100 V, for example, which is applied to the accelerating anode 60, the negative (−) output of the second generator G2 being connected to the reference voltage VR, that is, to the substrate 32.

As mentioned earlier, the elementary emitter device 31 is preferably (but not necessarily) constructed by means of a technology which is specific to integrated circuits and to the field of thin films, that is, by making use of a substrate and successive depositions of insulating and conductive films, and by adopting etching techniques which are commonly employed in the technology of integrated circuits and thin films. In consequence, a single substrate 32 is capable of carrying a large number (1 million, for example) of elementary electron devices such as the device 31 on a small surface area.

The elementary emitter devices which are mounted on one and the same substrate can be interconnected so as to form a complex circuit as in the case of an integrated circuit. It is also possible, for example, to associate these elementary emitter devices by mounting them in parallel so as to obtain the equivalent of a macroscopic cathode having a peak current value which could attain 100 amperes or more. In this case, all the emissive points 34 can be at the same reference potential VR. All the extracting electrodes 27 can be fabricated from one and the same electrically conductive layer 37 and are therefore connected to each other as may also be the case with all the control grids 29 and all the accelerating anodes 60. A structure of this type is illustrated in FIG. 2 in which the substrate 32 carries the first and the second elementary emitter devices 31, 31*b*. These two emitter devices 31, 31*b* belong, for example, to the same line which could comprise 1000 emitter devices of this type. A distance d4 of the order of a few micrometers to one hundred micrometers, for example, between the longitudinal axis X1 of each of these emitter devices 31, 31*b* can represent the pitch between two successive columns of such emitter devices. These columns extend in a plane perpendicular to that of the figure.

What is claimed is:

1. An electron source producing electrons which are intended to constitute at least one electron beam, comprising at least one electron-emitting device of the field emission type, the emitter device being provided with an electron-emissive point brought to a reference potential, an extracting electrode brought to a positive extraction potential with respect to the reference potential, the extracting electrode being provided with a hole for the passage of electrons emitted by the emissive point, wherein the emitter device is provided in addition with at least one control electrode placed downstream of the extracting electrode with respect to the direction of propagation of the beam, the control electrode being brought to a negative control potential with respect to the extracting electrode, and wherein means for accelerating the beam are placed downstream of the control electrode, and wherein the emissive point and the extracting and control electrodes are carried by one and the same substrate, and wherein the extracting and control electrodes are constituted by a succession of insulating and conductive layers deposited on the substrate and etched so as to constitute a well in which the emissive point is located.

2. An electron source according to claim 1, wherein one and the same substrate carries a plurality of emitter devices.

3. An electron source according to claim 1, wherein the substrate is of semiconductor material.

4. An electron source according to claim 2, wherein all the emissive points, all the extracting electrodes, all the control electrodes are electrically connected to each other.

5. An electron source according to claim 1, wherein the control potential applied to the control electrode is modulated by a modulating signal.

6. An electron source according to claim 1, wherein the control potential applied to the control electrode has a mean value substantially equal to the reference potential.

7. An electron source according to claim 1, wherein the emitter device comprises means for limiting the intensity of the electron current emitted by the emissive point when said intensity becomes too high.

8. An electron source according to claim 7, wherein the means for limiting the intensity of the electron current emitted by the emissive point comprise at least one resistor mounted in series between the extracting electrode and the extraction potential which is intended to be applied to said extracting electrode.

9. An electron source producing electrons which are intended to constitute at least one electron beam, comprising at least one electron-emitting device of the field emission type, the emitter device being provided with an electron-emissive point brought to a reference potential, an extracting electrode brought to a positive extraction potential with respect to the reference potential, the extracting electrode being provided with a hole for the passage of electrons emitted by the emissive point, wherein the emitter device is provided in addition with at least one control electrode placed downstream of the extracting electrode with respect to the direction of propagation of the beam, the control electrode being brought to a negative control potential with respect to the extracting electrode, and wherein means for accelerating the beam are placed downstream of the control electrode, and wherein the means for accelerating the beam comprise an auxiliary anode formed by an electrically conductive layer deposited on an insulating layer which is in turn deposited on the control electrode.

* * * * *